United States Patent [19]

Duff

[11] Patent Number: 4,713,028

[45] Date of Patent: Dec. 15, 1987

[54] SHALLOW WATER BOAT DESIGN

[76] Inventor: Don Duff, P.O. Box 246, Chavies, Ky. 41717

[21] Appl. No.: 875,921

[22] Filed: Jun. 19, 1986

[51] Int. Cl.[4] ..... B63H 5/12

[52] U.S. Cl. ..... 440/61; 440/69; 248/641

[58] Field of Search ..... 440/49, 53, 54, 59–63, 440/66–71, 900, 88; 248/641

[56] References Cited

U.S. PATENT DOCUMENTS

| | | | |
|---|---|---|---|
| 1,227,357 | 5/1917 | Yarrow | 440/69 |
| 1,473,832 | 11/1923 | Park | 440/69 |
| 2,775,219 | 12/1956 | Curtis | 440/61 |
| 2,908,242 | 10/1959 | Forbes et al. | 440/61 |
| 3,075,490 | 1/1963 | Lang | 440/53 |
| 3,431,882 | 3/1969 | Irgens | 440/88 |
| 3,469,557 | 9/1969 | Wollard | 440/69 |
| 4,000,712 | 1/1977 | Erikson et al. | 114/77 R |
| 4,232,627 | 11/1980 | Glenn et al. | 440/61 |
| 4,395,238 | 7/1983 | Payne | 440/53 |
| 4,406,635 | 9/1983 | Wuhrer | 440/69 |
| 4,482,330 | 11/1984 | Cook | 440/2 |

FOREIGN PATENT DOCUMENTS

| | | | |
|---|---|---|---|
| 410400 | 3/1925 | Fed. Rep. of Germany | 440/54 |
| 2096962 | 10/1982 | United Kingdom | 440/54 |

*Primary Examiner*—Sherman D. Basinger
*Assistant Examiner*—Stephen P. Avila
*Attorney, Agent, or Firm*—King and Schickli

[57] ABSTRACT

A boat provides full operation even in shallow water utilizing an outboard motor. The boat includes a main hull, a displaceable transom to which the motor is mounted and a displaceable hull section. The displaceable transom is received in sliding engagement within two guide brackets mounted to the main hull. The displaceable hull section is connected to the displaceable transom by a hinge along a rear edge. The leading edge of the displaceable hull section is received and rests within a lip in the main hull. Actuator cylinders mounted in alignment with the guide brackets raise and lower the transom and the rear end of the displaceable hull section while the leading edge of the displaceable hull section pivots and slides in the lip. When the motor is raised for shallow water operation the displaceable hull section forms a flow channel for directing water to the propeller and intake port of the motor so as to prevent damage and provide proper and efficient water cooling.

14 Claims, 6 Drawing Figures

SHALLOW WATER BOAT DESIGN

BACKGROUND OF THE INVENTION

The present invention relates generally to the boating field and, more particularly, to a boat allowing full performance and improved operation in shallow water even over an extended period of time.

Sport fishermen often must traverse an expansive area of relatively shallow water in order to reach productive fishing areas that are also often located in this shallow water. The depth of this water does not always allow safe operation of an outboard motor. Not only may the propeller of the motor become bent or chipped from hitting the bottom, but the lower unit of the outboard motor could, for example, also suffer severe damage. This not only may lead to the inconvenience of having to paddle back to the dock, but to exceedingly costly repairs as well.

In order to avoid the possibility of such a calamity, it has been necessary in the past to either: (1) avoid fishing in these productive shallow water areas altogether; (2) approach these areas only by land, an alternative often impossible in remote regions; or (3) tilt the outboard motor out of the water and utilize an electric trolling motor for power.

A number of advances have been made in the electric trolling motor art in recent years, but these motors still suffer from the limited power available from storage batteries. As such, electric trolling motors provide acceptable operation for only short time periods and over limited areas.

Thus, on any attempt at crossing large expanses of shallow water as discussed above, the batteries become weak and the electric trolling motor ineffective. Further, it should be appreciated that, for example, during fishing tournaments time is critical. Under these circumstances, the electric trolling motor simply cannot power the boat fast enough to reach the desired remote fishing location and still allow adequate time for fishing.

In the past outboard motor mounting brackets have been developed that allow vertical movement of the motor relative to the boat transom. U.S. Pat. Nos. 4,232,627 to Glenn et al and 4,482,330 to Cook disclose specific examples of such devices. These devices or systems were designed to allow the boat operator to adjust the "trim" of the boat under varying speed and/or load conditions for maximum efficiency and performance. They also allow some adjustment for boat operation in shallow water.

Specifically, by raising the motor, the boat may be operated in more shallow water with less of a chance of grounding and damaging the prop and motor. Still, however, it should be appreciated that motor operation is somewhat limited.

With the motor raised, the boat hull effectively blocks the cooling water intake port of the engine from a straight flow-through stream of water. Thus, at medium speeds and above, the intake port contacts the water only intermittently and engine cooling suffers. As such, outboard motor operation can continue only at relatively slow speeds for limited periods of time in order to prevent motor overheating.

The need is, therefore, clearly identified for a boat design allowing full and safe operation of an outboard motor even in shallow water for extended periods of time.

SUMMARY OF THE INVENTION

Accordingly, it is a primary object of the present invention to overcome the above-described limitations and disadvantages of the prior art.

Another object of the present invention is to provide a boat allowing full operation of an outboard motor in shallow water.

A further object of the present invention is to provide a boat allowing the raising of the outboard motor to substantially reduce the chances of grounding and damaging the outboard motor during operation in shallow water.

Still another object of the present invention is to provide a boat allowing the raising of an outboard motor for shallow water operation along with improved cooling for the motor in the raised position.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved boat is provided for full operation in shallow water with an outboard motor. The boat includes a main hull along with a displaceable transom that supports the outboard motor. The displaceable transom may be lowered for normal operation and raised for shallow water operation. A displaceable hull section is connected to the displaceable transom so as to follow the movement thereof. When the displaceable transom is raised to raise the motor and reduce the chances of the motor grounding in shallow water, the displaceable hull section is also raised. Advantageously, when raised the displaceable hull section provides a flow channel that directs water to the propeller and to the cooling intake port of the motor for proper and efficient cooling.

More specifically, two guide brackets are mounted to the main hull. Opposite sides of the displaceable transom are slidably received in the guide brackets. Two hydraulic actuator cylinders are mounted to the main hull and connected to the displaceable transom. One cylinder is aligned with each guide bracket to assure smooth raising and lowering of the displaceable transom and outboard motor.

Preferably, the main hull includes a recessed hull compartment. The displaceable hull section is received in the hull compartment, which is sealed so as to prevent water intrusion into the main hull.

For added strength and structural integrity, the displaceable hull section is substantially U-shaped. The hull section is connected to the displaceable transom through a hinge which allows smooth consistent operation. The leading edge of the hull section is received and rests within a lip in the main hull. A beam overlies the hull section adjacent the lip to maintain the hull section in position against the forces of the water during boat operation. Preferably, the upper side walls of the displaceable hull section are angled to assure that the beam engages the hull section in all its operating positions.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments, and its several details are capable of modifications in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of this specification, illustrates several aspects of the present invention, and together with the description serves to explain the principles of the invention. In the drawing.

Figure 1:
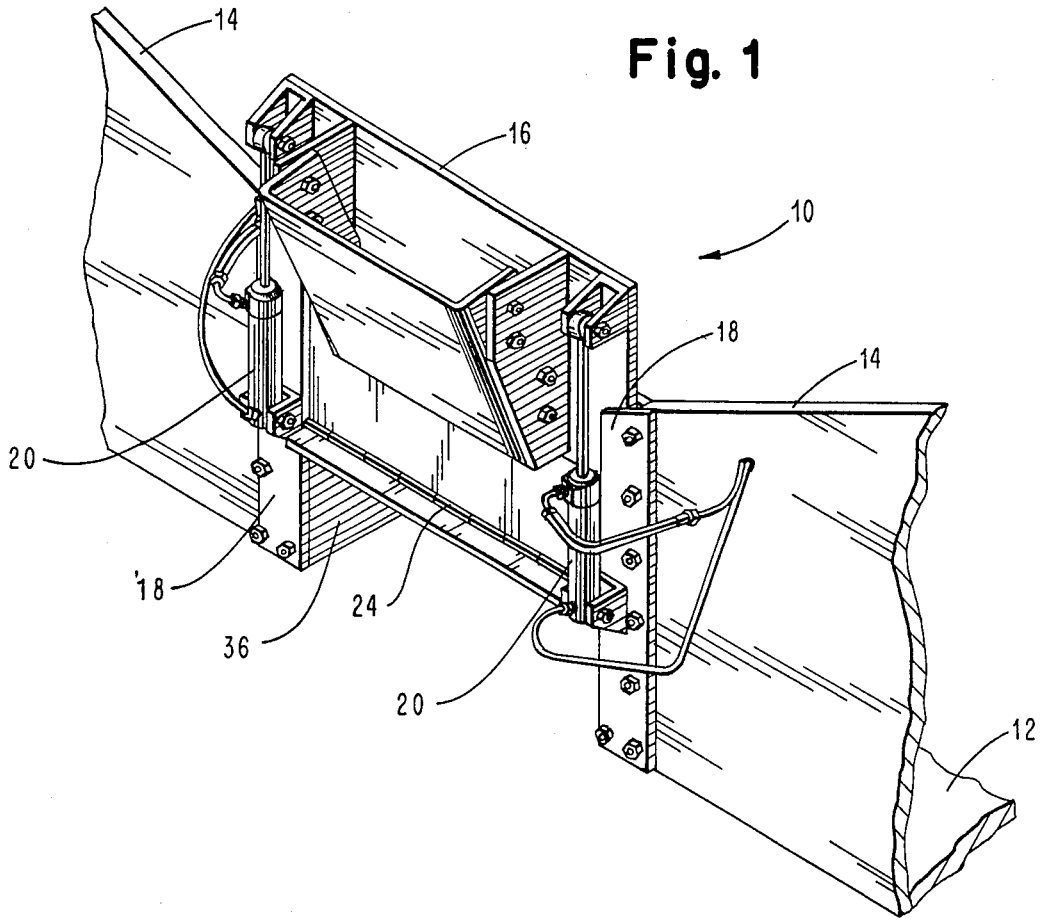
FIG. 1 is a cut-away perspective of a boat constructed in accordance with the teachings of the present invention including a displaceable transom and displaceable hull section.

Reference will now be made in detail to the present preferred embodiment of the invention, an example of which is illustrated in the accompanying drawing.

DETAILED DESCRIPTION OF THE INVENTION

Reference is now made to the drawing figures showing a boat 10 incorporating the improvements of the present invention for full operation in shallow water. The boat 10 includes a main hull 12 having a transom 14 at the stern. The main hull transom 14 includes a centrally located displaceable transom 16 to which the outboard motor M is mounted.

As best shown in FIG. 1, the displaceable transom 16 is mounted to the main hull transom 14 by means of a pair of guide brackets 18. Each guide bracket 18 defines a groove for slidably receiving a side of the displaceable transom 16. A pair of hydraulic actuator cylinders 20 mounted to the main hull transom 14 through the guide brackets 18 allow selective lowering of the displaceable transom 16 and motor M for normal operation and raising of the transom 16 and motor M for shallow water operation. One cylinder 20 is provided in line with each guide bracket 18 to ensure smooth, even lifting and lowering action and prevent binding of the displaceable transom 16 in the guide brackets.

Figure 3:
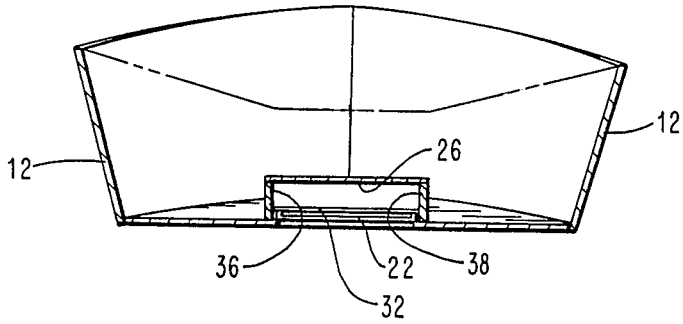
FIG. 3 is a transverse cross-sectional view of the boat in FIG. 1 with the displaceable transom and hull section in the lowered position.
Figure 4:
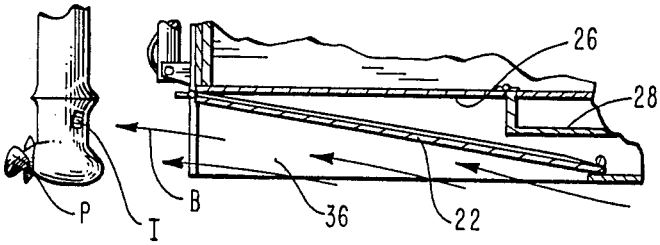
FIG. 4 is a cross-sectional schematical view showing the flow of water toward the outboard motor with the displaceable transom and center hull section in the raised position.

A displaceable hull section 22 is positioned along the transverse mid-line of the hull (see FIG. 3) and is connected to the displaceable transom 16 at hinge 24 (see FIG. 4). As will be more fully described below, the displaceable hull section 22 follows the movement of the displaceable transom and when raised provides a flow channel for directing water to the propeller P and intake port I of the motor for proper and efficient cooling (note FIGS. 4, 4*a*). The displaceable hull section 22 essentially acts as a false bottom and is received within a recessed hull compartment 26. The hull compartment 26 is sealed to the main hull 12 in front, at the sides and above so as to prevent water intrusion. As shown, the hull compartment 26 may be further divided to include a water-tight cavity 28 for the boat battery, tools or other equipment.

The hull section 22 has relatively short side walls that provide the substantially U-shaped crosssection. This structure provides for added strength. The leading edge of the displaceable hull section 22 is received and rests within a lip 30 in the main hull 12 that serves to maintain the hull section in its proper aligned position.

A beam 32 overlies the displaceable hull section 22 adjacent the lip 30 so as to maintain the leading edge of the hull section captive against the lip at all times. As should be appreciated, the short side walls of the hull section are angled at 34 relative to the horizontal to assure engagement between the overlying beam 32 and the leading edge of the displaceable hull section 22 within the lip 30 at all adjusted positions, i.e. whether the displaceable hull section is raised as in FIG. 2, or lowered as in FIG. 2*a*.

Figure 2:
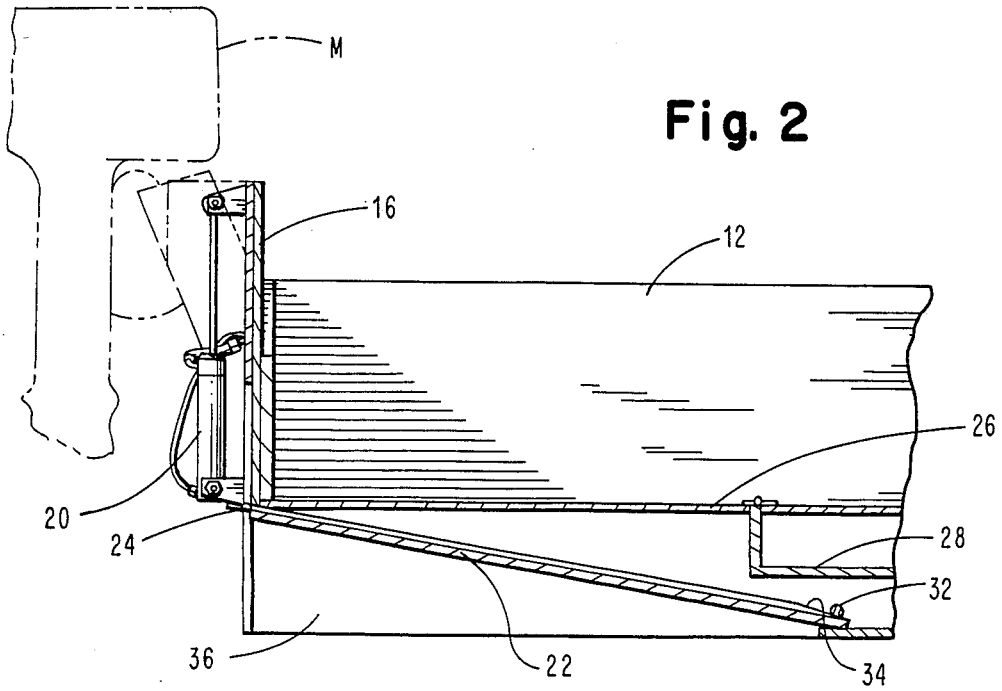
FIG. 2 is a cross-sectional view showing the displaceable transom and hull section in the raised position.
Figure 2A:
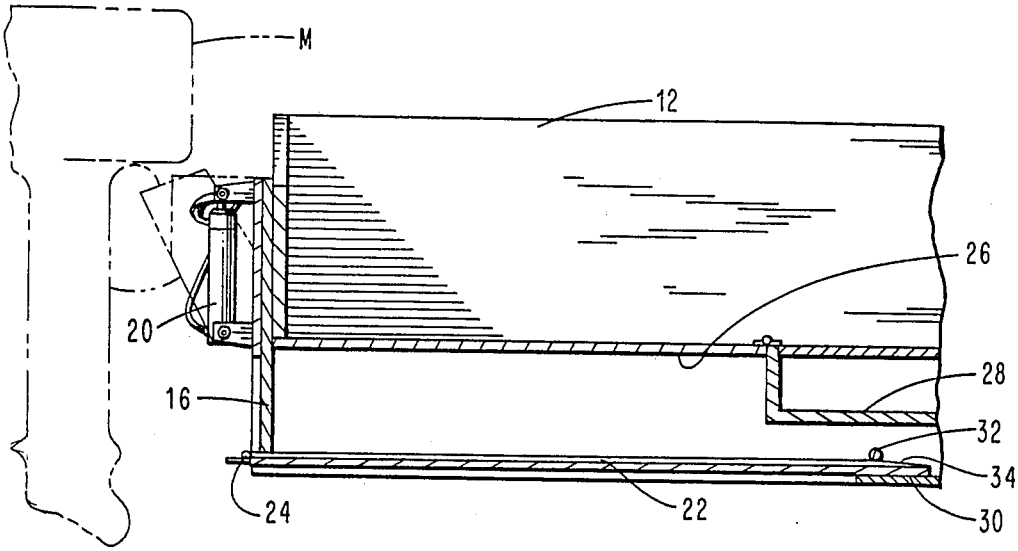
FIG. 2*a* is a cross-sectional view similar to FIG. 2 showing the displaceable transom and hull section in the lowered position.
Figure 4A:
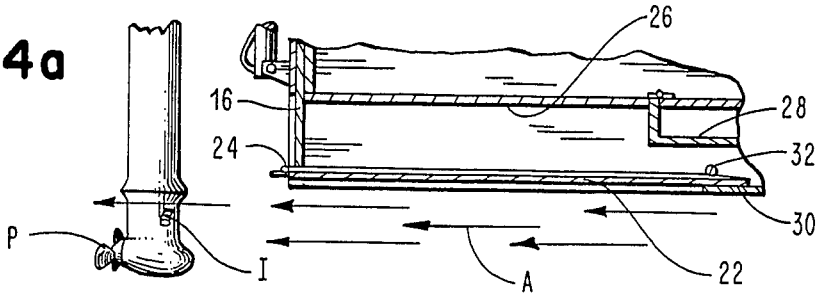
FIG. 4*a* is a view similar to FIG. 4 showing the flow of water with the displaceable transom and hull section in the lowered position.

During normal boat operation where the water is deep enough and there is little or no concern of running the motor aground, the displaceable transom 16 and displaceable hull section 22 may be lowered as shown in FIGS. 2*a* and 4*a*. With the displaceable hull section 22 maintained in position within the lip of the main hull 30 at the leading edge by the beam 32 and at the trailing edge by the displaceable transom 16, a "full hull" effect is achieved. As with a state of the art hull the water flows straight back along the bottom of the hull to the motor M and to the cooling intake port I of the motor for proper motor cooling.

Upon reaching shallow water that it is desired to traverse, the displaceable transom 16 and displaceable hull 22 are raised as shown in FIGS. 2 and 4 by actuation of the cylinders 20. With the motor raised the chances of grounding the motor into the shallow bottom of the lake or stream is greatly reduced. As such, the possibility of extensive damage to the propeller and lower end unit of the motor M is substantially eliminated.

Advantageously, with the features of the present invention the motor M is also fully operational in this raised position. Specifically, even when the trailing edge of the displaceable hull section 22 is raised, the leading edge is retained in the lip 30 by the beam 32. Thus, the displaceable hull section 22 within the sealed hull compartment 26 is inclined upwardly toward the motor M. In effect, the displaceable hull section 22 and the side walls 36, 38 of the hull compartment 26 form a flow channel that directs water to the motor prop P and cooling water intake port I. With water directed to the prop, the prop is maintained in the water at all times for maximum efficiency. With water directed into the cooling water intake port I, motor M overheating is prevented. As such, the motor is fully operational in the raised position allowing the utilization of full power without damage to the motor even in shallow water.

In summary, numerous benefits have been described which result from employing the concepts of the invention. A boat is provided allowing safe operation in shallow water through the raising of the motor M with actuator cylinders 20. If desired, high speed operation of the motor for an extended period of time in the raised position is possible. A flow channel formed by the displaceable transom 16 and displaceable hull section 22 when in the raised position directs water to the motor prop and cooling intake port. Both maximum prop operating efficiency and protection are maintained. The water in the flow channel directed toward the prop assures full encircling of the prop and thus maintaining it in the water at all times, as desired. The cooling efficiency of the motor is also maintained with the water from the flow channel being directed into the cooling intake port of the motor.

The foregoing description of a preferred embodiment of the invention has been presented for purposes of illustration and description It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

I claim:

1. A boat allowing full operation in shallow water utilizing an outboard motor with propeller and cooling water intake port, comprising:

a main hull;

a displaceable transom of said main hull supporting said motor to be lowered for normal operation and raised for shallow water operation;

a displaceable hull section; and means for pivotally connecting said displaceable hull section to said displaceable transom so as to follow the movement thereof;

whereby raising said displaceable transom serves to raise said motor and prevent damage to said propeller as well as raise said displaceable hull section so as to provide a flow channel for directing water to the propeller and intake port of the motor for proper and efficient cooling.

2. The boat recited in claim 1, further including power means for raising and lowering said displaceale transom.

3. The boat recited in claim 2, wherein said power means is at least one hydraulic cylinder.

4. The boat recited in claim 1, wherein said main hull includes a sealed, recessed hull compartment, said hull compartment receiving said displaceable hull section and preventing water intrusion around said displaceable hull section into said main hull.

5. The boat recited in claim 1, wherein said displaceable hull section is positioned in line with said motor so as to direct water through the flow channel toward said motor when in the raised position.

6. The boat recited in claim 5, wherein said displaceable hull section is centrally located along a transverse midline of said main hull.

7. The boat recited in claim 1, wherein a hinge connects said displaceable hull section to said displaceable transom.

8. The boat recited in claim 1, wherein a leading edge of said displaceable hull section is received and rests within a lip in said main hull.

9. The boat recited in claim 8, wherein a means is provided for retaining said leading edge of said displaceable hull section within said lip.

10. The boat recited in claim 9, wherein said retaining means includes a beam overlying said displaceable hull section adjacent said lip.

11. The boat recited in claim 10, wherein said displaceable hull section includes upper side walls that are angled relative to the horizontal so as to provide a beam engaging surface when said displaceable transom and hull section are in both the raised and lowered positions.

12. A boat allowing full operation in shallow water utilizing an outboard motor with propeller and cooling water intake port, comprising:

a main hull;

a displaceable transom of said main hull supporting said motor to be lowered for normal operation and raised for shallow water operation;

two guide brackets mounted to said main hull, opposite sides of said displaceable transom being slidably received in said guide brackets; and a displaceable hull section connected to said displaceable transom so as to follow the movement thereof;

whereby raising said displaceable transom serves to raise said motor and prevent damage to said propeller as well as raise said displaceable hull section so as to provide flow channel for directing water to the propeller and intake port of the motor for proper and efficient cooling.

13. The boat recited in claim 12, wherein two actuator cylinders are mounted to said main hull for raising and lowering said displaceable transom, one actuator cylinder being aligned with each guide bracket to assure smooth operation.

14. A boat allowing full operation in shallow water utilizing an outboard motor with propeller and cooling water intake port, comprising:

a main hull;

a displaceable transom of said main hull supporting said motor to be lowered for normal operation and raised for shallow water operation; and a displaceable hull section connected to said displaceable transom so as to follow the movement thereof, said displaceable hull section including a substantially U-shaped cross section for added strength;

whereby raising said displaceable transom serves to raise said motor and prevent damage to said propeller as well as raise said displaceable hull section so as to provide a flow channel for directing water to the propeller and intake port of the motor for proper and efficient cooling.

* * * * *